United States Patent [19]

Krebaum et al.

[11] 4,210,110

[45] Jul. 1, 1980

[54] CARBURETOR CONTROL DEVICE

[76] Inventors: Lawrence J. Krebaum, 4501 W. Gardenia, Glendale, Ariz. 85301; Gerald E. Krebaum, 12666 N. Columbine Dr., Phoenix, Ariz. 85029

[21] Appl. No.: 822,896

[22] Filed: Aug. 8, 1977

Related U.S. Application Data

[63] Continuation-in-part of Ser. No. 700,456, Jun. 28, 1976, abandoned.

[51] Int. Cl.[2] ..... F02D 11/08

[52] U.S. Cl. ..... 123/319; 261/DIG. 18

[58] Field of Search ..... 123/97 R, 103 R, 103 B, 123/103 E; 251/54; 261/65, DIG. 18

[56] References Cited

U.S. PATENT DOCUMENTS

| | | | |
|---|---|---|---|
| 2,090,246 | 8/1937 | Alexander | 251/54 |
| 2,695,153 | 11/1954 | Gillaspy | 251/54 |
| 2,809,623 | 10/1957 | Hall | 261/DIG. 18 |
| 3,216,707 | 11/1965 | Walker et al. | 261/65 |
| 3,456,632 | 7/1969 | Rhodes | 123/103 R |
| 3,805,760 | 4/1974 | Yagi et al. | 123/103 R |
| 3,958,542 | 5/1976 | Tanner | 123/103 E |
| 4,010,720 | 3/1977 | Gram | 123/103 E |
| 4,019,475 | 4/1977 | Nuss | 123/103 E |
| 4,060,063 | 11/1977 | Hirasawa | 123/103 R |

*Primary Examiner*—Charles J. Myhre
*Assistant Examiner*—Craig R. Feinberg
*Attorney, Agent, or Firm*—Gregory J. Nelson

[57] ABSTRACT

A resiliently deformable link is interposed between the throttle linkage and the throttle lever of a carburetor normally associated with a conventional internal combustion engine. The resiliently deformable member receives and stores energy during acceleration movements of the linkage and transmits the energy to the throttle lever for opening the throttle valve. A pneumatic restrictor such as a dashpot or bellows opposes the opening of the throttle valve in response to the resiliently deformable member. The rate of discharge of air into or from a chamber within the pneumatic restrictor modulates the rate of opening the throttle valve. Air flow is regulated by air bleed means which may be an adjustable atmospheric vented valve or other means responsive to engine manifold vacuum.

Biasing means serve to urge the throttle lever toward a closed throttle position.

2 Claims, 12 Drawing Figures

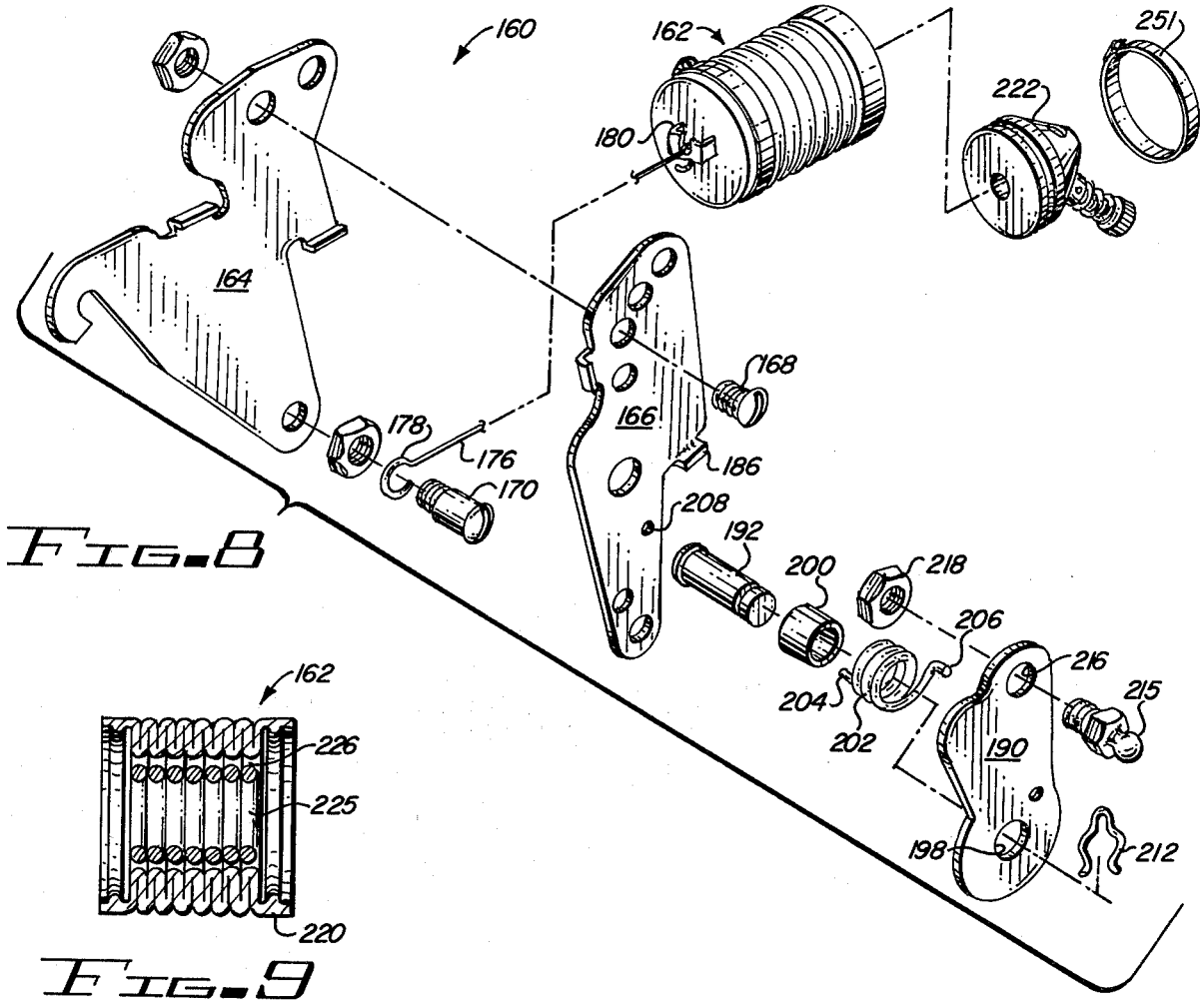
FIG. 8
FIG. 9
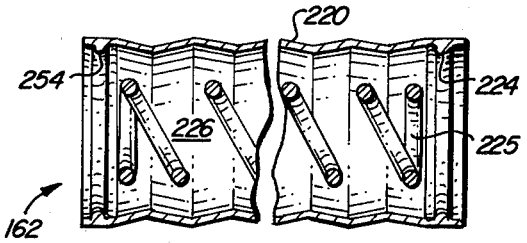
FIG. 10
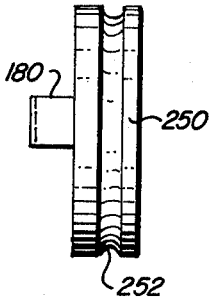
FIG. 11
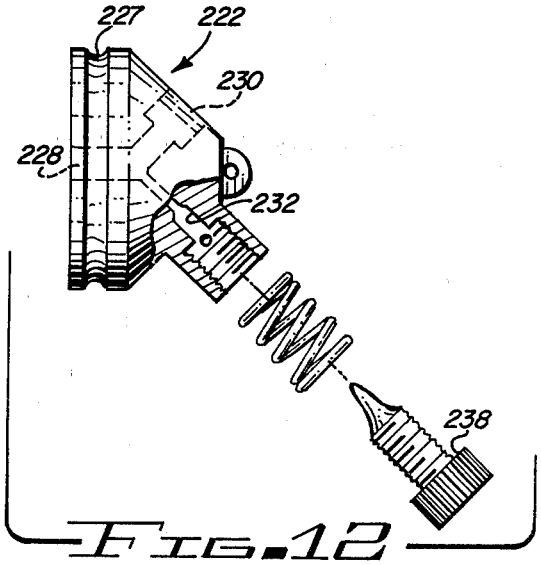
FIG. 12

CARBURETOR CONTROL DEVICE

This application is a continuation-in-part of our copending application Ser. No. 700,456, filed June 28, 1976, entitled, "CARBURETOR CONTROL DEVICE", now abandoned.

This invention relates to normally aspirated or carburetor fueled internal combustion engines.

In a further aspect the present invention relates to the carburetion and delivery of air fuel mixture to the engine.

More particularly the instant invention concerns a device for modulating the rate of opening of the throttle valve during periods of acceleration.

In the conventional normally aspirated internal combustion engine the air fuel mixture is controlled and supplied to the engine by a carburetor mounted upon the intake manifold. Briefly, and in general terms, the carburetor has a lower section commonly referred to as the main body or throttle body and an upper section usually termed the cover or air horn. A bore provides for passage of air through the carburetor and communicates with the individual cylinders through the intake valves and the intake manifold. A venturi section and a throttle valve are located in the bore. As air passes through the bore fuel is entrained into the air stream from the fuel supply within the float bowl.

The opening in the bore and thus the volume of air which may pass through the bore is controlled by the throttle valve. The throttle valve is generally connected by means of a shaft to a throttle lever located externally of the carburetor. A return spring engaged with the throttle lever normally urges the throttle valve in the closed position. The throttle valve is opened in response to throttle linkage extending between the throttle lever and manually operable means, such as the accelerator pedal, located in the driver's compartment. The linkage may be provided by such diverse means as rods, cables, hydraulic systems, and electric solenoids.

In the normal manner of operating a vehicle powered by a carburetor fueled engine, force applied to the throttle pedal, generally by the foot of the vehicle operator, actuates the linkage which opens the throttle valve which allows more air to flow through the carburetor bore. The movement of air through the bore is in response to the vacuum created within the cylinder as it moves through the intake cycle, as is well known in connection with Otto cycle engines. The increased flow of air through the venturi, in accordance with the Bernoulli principle, causes more air to flow through the primary jet into the air stream such that the ratio of air to fuel is approximately fourteen-to-one. The increase of available fuel mixture, air and fuel, allows the engine to accelerate.

However, if a carburetor were to have only main jets the low velocity air through the throttle bore under conditions of low manifold vacuum would not draw sufficient fuel to develop adequate power to accelerate the vehicle at an acceptable rate. Modern vehicular carburetors, therefore, have accelerator pumps and vacuum operated power jets which immediately supply additional fuel and alter the air fuel ratio to approximately twelve-to-one or even richer. It is in this range that maximum power is developed. The enrichening devices respond instantaneously to even the most rapid throttle motions whereas the engine accelerates somewhat more slowly because of engine and vehicular inertia. During the time between when the throttle is opened and when the engine develops enough speed to burn the fuel efficiently, exceedingly rich fuel mixtures are attained and fuel is wasted.

Devices for retarding the opening of carburetor throttles are known in the prior art. Attention is particularly directed to U.S. Pat. No. 3,329,135 issued to Brooks Walker and U.S. Pat. No. 3,961,854 issued to Richard E. Barton et al. A primary function of these devices is to retard throttle valve opening as the engine speed increases. This, of course, is in direct opposition to restricting opening during periods of low manifold vacuum as the throttle is abruptly opened and engine speed is too low to utilize the fuel introduced by the power jet or other fuel enrichening devices. Further, such devices are considered hazardous since they restrict acceleration which may be needed in an emergency as might occur during a high speed passing maneuver.

Other related patents describe a solid length between the throttle and a slow acting hydraulic dashpot for controlling throttle closing. U.S. Pat. No. 2,809,623 issued to Fred B. Hall describes an exceedingly complex system which involves modification of the normal fuel mixing system. Throttle changes, opening and closing, are controlled by a system of springs and a hydraulic dashpot. Mechanism is provided for overcoming the springs and producing controlled throttle opening in response to heavy throttle pedal pressure. Immediate closing of the throttle valve in response to the release of pressure from the throttle pedal is mandatory to stop acceleration and to gain benefit of the normal braking function of the engine. When throttle valve closing is controlled by a hydraulic dash pot these engine functions are lost since hydraulic dash pots are inherently slow acting due to the time necessary for the liquid to pass through a check valve or other bypass system. Also, such devices are prone to sticking if the hydraulic fluid thickens as a result of temperature or aging or becomes contaminated. It is obvious that a sticking dash pot controlling throttle closing produces an extremely dangerous situation since the engine could remain at a high speed open throttle position resulting in loss of control of the vehicle by the operator.

It would be highly advantageous, therefore, to provide improved means for proper control of a carburetor during acceleration while not restricting the normal function thereof during deceleration.

Accordingly, it is a principle object of the present invention to provide a carburetor control device which can be readily and simply installed in connection with pre-existing carburetors or alternately incorporated into new carburetors by the manufacturer.

Another object of the invention is the provision of means to restrict the action of the carburetor throttle valve, accelerator pump and power jet system to inject only that amount of fuel which can be utilized efficiently as the engine accelerates.

Another object of the invention is to provide a carburetor control device which will monitor throttle valve opening throughout the speed range of the engine and which will not interfere with deceleration or the normal closing of the throttle valve.

A further object of the invention is the provision of a throttle control device which will prevent overfueling of the engine during periods of low intake manifold vacuum, thus increasing fuel economy while not reducing the maximum acceleration rate of the vehicle.

Yet a further object of the invention is to provide a device which will dampen rapid accelerator movements such as imparted to the throttle pedal by the operator's foot when driving over rough or bumpy terrain.

And a further object of the instant invention is the provision of a device of the above type which is relatively simple and inexpensive to manufacture yet is highly efficient and reliable, requiring minimal maintenance.

Briefly, to achieve the desired objectives of the present invention in accordance with a preferred embodiment thereof provided is a resiliently deformable member which can either be compressible or expandable expandible, such as a spring, which is interposed between the throttle linkage and the throttle lever. In response to opening movements of the throttle linkage such as by depressing the throttle pedal by the vehicle operator, the resilient member is compressed stornign energy therein which is then transmitted to the throttle lever for opening the throttle valve. Opening movement of the throttle lever is opposed by the normal carburetor return spring and by a pneumatic restrictor such as a dashpot or bellows. The dashpot includes a flexible diaphragm hermetically sealed to a hollow housing to form an airtight chamber therein. Biasing means nromally urge the diaphragm in a first direction which increases the volumetric capacity of the chamber and during which time ambient air is introduced into the chamber through a one-way check valve. A flexible coupling having a predetermined maximum length communicates between the diaphragm and the throttle lever such that opening movement of the throttle lever in response to the compressible member moves the diaphragm in a second direction which decreases the volumetric capacity of the dashpot. Air bleed means are provided for controlling the rate of discharge of air from the chamber as the diaphragm moves in the second direction. In another preferred embodiment a bellows opposes movement of the throttle lever. Air is bled into the bellows on expansion to modulate the rate of opening of the throttle.

DESCRIPTION OF THE DRAWINGS

The foregoing and further and more specific objects and advantages of the present invention will become readily apparent to those skilled in the art from the following detailed description of the preferred embodiments thereof taken in conjunction with the drawings in which:

FIG. 8 is an exploded perspective view illustrating an alternate preferred embodiment of the present invention;

FIG. 9 is a cross sectional view of the bellows shown in FIG. 8 in a compressed condition;

FIG. 10 is a cross sectional view of the bellows shown in FIG. 8 in an expanded condition;

FIG. 11 is a side view of one end plate of the bellows; and

FIG. 12 is a side view of the other end plate of the bellows shown in FIG. 8.

Figure 1:
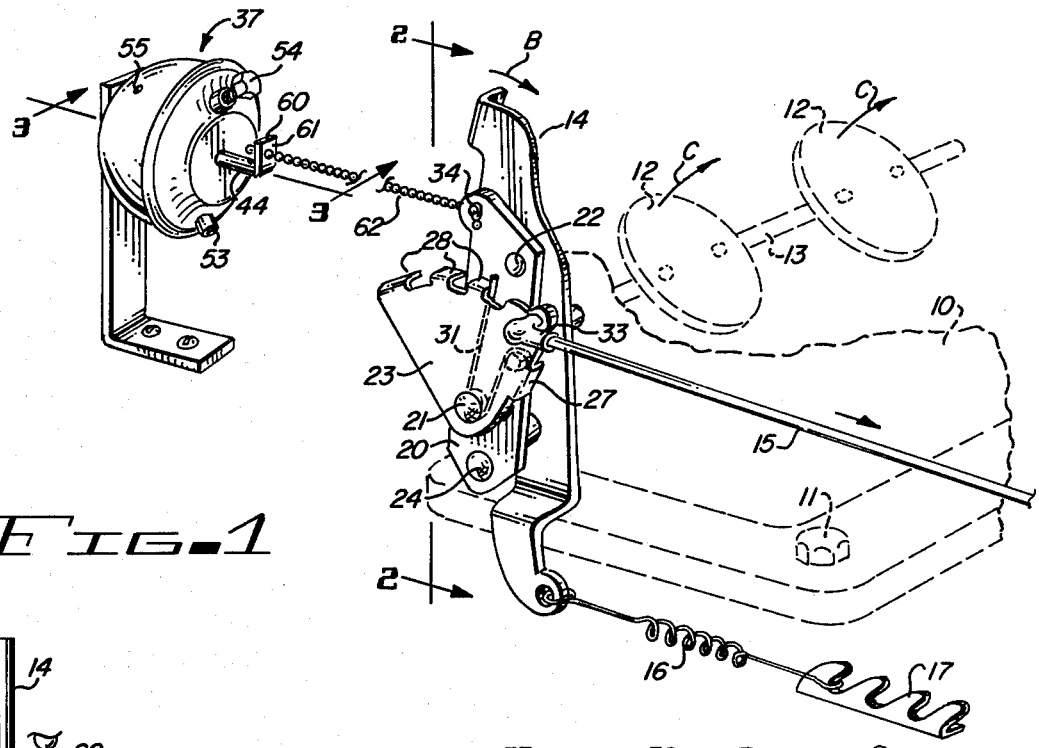
FIG. 1 is a perspective view of a carburetor control device constructed in accordance with the teachings of the present invention as it would appear when operatively installed with a conventional carburetor, the carburetor being shown partially and in broken line.

Turning now to the drawings in which the same reference numerals indicate corresponding elements throughout the several views attention is first directed to FIG. 1 which shows, in dashed outline, the lower portion or throttle body 10 of a conventional carburetor which is secured to the intake manifold of an internal combustion engine by bolts 11. Throttle valves 12 regulate air flow through the throttle bores (not herein specifically illustrated). Throttle valves 12 are secured to shaft 13 which extends externally of throttle body 10 and has throttle lever 14 secured thereto. Rod 15 is part of the accelerator linkage and is responsive to movements of the throttle or accelerator pedal located within the operator's compartment. Normally rod 15 is secured directly to throttle lever 14.

When the accelerator pedal is depressed rod 15 moves in the direction of arrow A rotating throttle lever 14 in the direction of arrow B. Shaft 13 rotatable within throttle body 10 and fixedly secured to throttle lever 14 rotates with throttle lever 14 and provides the axis of rotation thereof. During rotation of shaft 13 throttle valves 12 rotate in the direction indicated by arrow C to provide a greater opening in the throttle bore. The opening of throttle valves 12 is opposed by throttle return spring 16 which extends between throttle lever 14 and bracket 17 which is normally secured to the engine. When pressure on the accelerator pedal is released throttle return spring 16 urges throttle layer 14 in a direction opposite to arrow B thus closing throttle valves 12. The foregoing partial description of a carburetor and the throttle or accelerator linkage is included herein for purposes of orientation to the instant invention. Since those skilled in the art to which the instant invention pertains are thoroughly familiar with conventional carburetors and operation thereof further description is not necessary.

Figure 2:
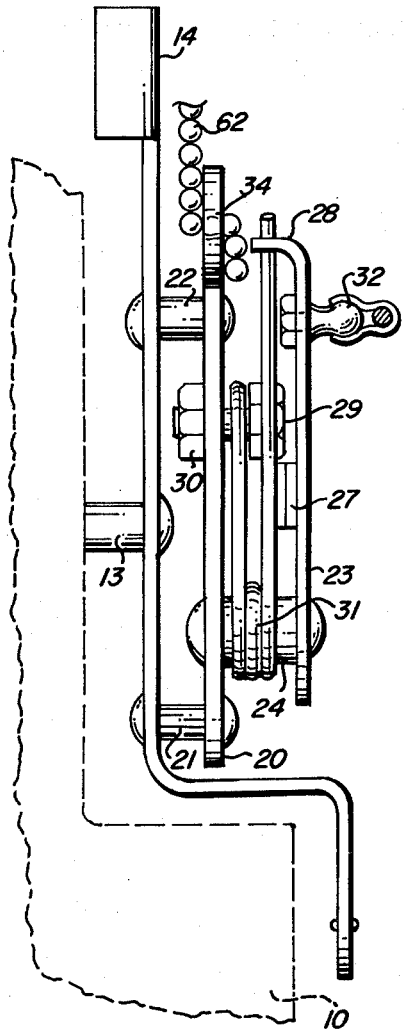
FIG. 2 is a vertical sectional view of the device of FIG. 1 taken along in line 2—2 thereof and particularly illustrating the portion thereof attached to the conventional carburetor throttle lever.

With reference to the immediate embodiment of the instant invention, as is also seen in FIG. 2, adaptor plate 20 is securely affixed to throttle lever 14 by standoff rivets 21 and 22 or by any other convenient means. Secondary throttle lever 23 is pivotally connected in spaced relationship to adaptor plate 20 by pin 24. Secondary throttle lever 23 has a projection extending inwardly from the rear edge thereof and a series of spaced inwardly directed fingers 28 along the top edge thereof. A projection as provided by shoulder bolt 29 and nut 30 extends from adaptor 20. Torsion spring 31 has the coiled portion thereof engaged about pin 21 with one leg bearing against shoulder bolt 29 and the other leg bearing against one of said fingers 28. Consistent with conventional practice, a ball connector 32 receives ball socket clip 33 affixed to the end of accelerator rod 15. The action of torsion spring 31 normally urges adaptor plate 20 and concurrently throttle layer 14 in the direction of arrow B when secondary throttle lever 23 is held stationary by accelerator rod 15. It is noted that adaptor plate 20 also has an aperture 34 proximate the upper end thereof.

Figure 3:
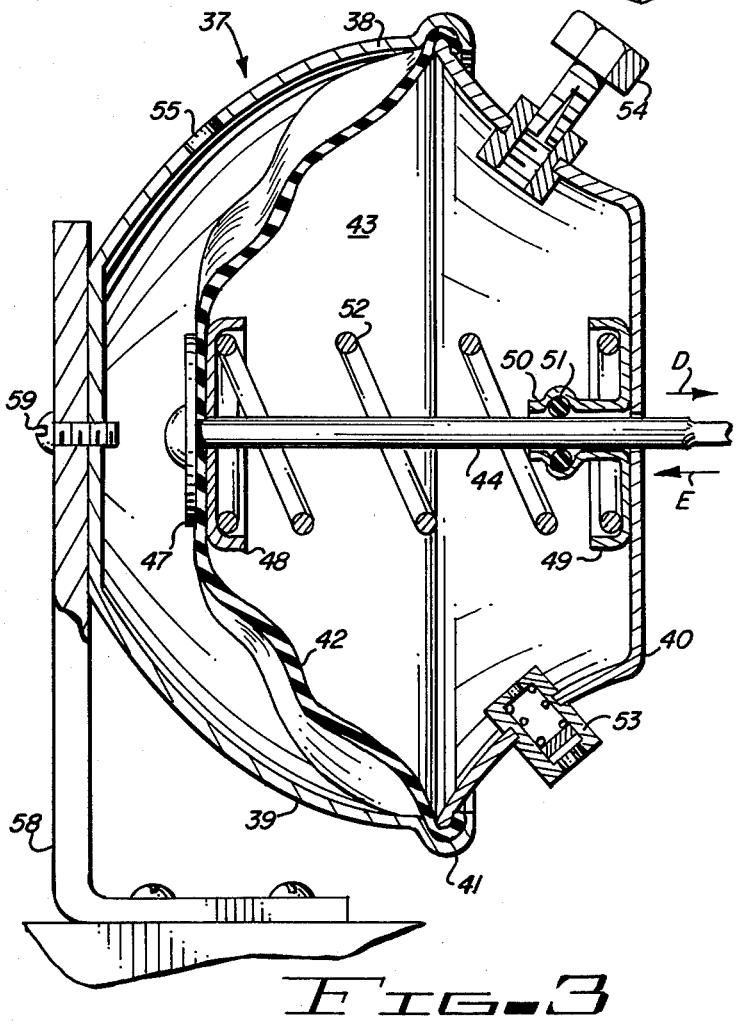
FIG. 3 is a vertical sectional view taken along the line 3—3 of FIG. 1 and further illustrating the pneumatic dashpot used in connection with the instant invention.

FIG. 3 further illustrates a penumatic restrictor in the form of a dashpot generally designated by the reference character 37 which functions as a pneumatic restrictor in accordance with an embodiment of the instant invention. Dashpot 37 has a hollow housing 38 which is fabricated from two cup-shaped shalves 39 and 40 adjoined along crimped seam 41. The periphery of flexible diaphragm 42 is also engaged in crimped seam 41 to form airtight chamber 43 with cup-shaped half 40.

Plunger 44 extends through chamber 43. At the inner end plunger 44 is secured to diaphragm 43 by washer 47 and cup-shaped member 48. The enlarged size of washer 47 and cup-shaped member 48 eliminate localized stress upon diaphragm 42 to insure greater life of the diaphragm. Cup-shaped member 49 corresponding in size to cup-shaped member 48 is secured to housing half 40 and has a central tubular hub 50 through which plunger 44 passes as it extends exterior of chamber 43. O-ring seal 51 carried by hub 50 preserves the integrity of airtight chamber 43. Compression type coil spring 52 encircles plunger 44 and is received at respective ends thereof in cup-shaped member 48 and 49.

It is obvious that as plunger 44 moves in the direction of arrow D drawing diaphragm 42 towards housing half 40 the volumetric capacity of chamber 43 is reduced. Similarly as plunger 44 moves in the direction of arrow E as assisted by spring 52 diaphragm 42 moves away from housing half 40 resulting in an increase of volumetric capacity of chamber 43. During increases in volumetric capacity of chamber 43 air is drawn through conventional one-way spring loaded check valve 53. Adjustable bleed screw 54 of conventional slotted thread design provides controlled escape of air in chamber 43 during movement of plunger 44 in the direction of arrow D. Aperture 55 in housing half 39 vents the interior of the housing half to the atmosphere such that the pressure within housing half 39 remains at atmospheric. Mounting bracket 58 is secured to dash pot 37 by screw 59 and is mounted upon an appropriate surface within the engine compartment by any convenient means.

An angular flange 60 having aperture 61 therethrough is integral with the external end of plunger 44. Respective ends of bead chain 62 pass through and are secured within aperture 34 and 61. Bead chain 62 provides a flexible coupling having a predetermined maximum length. Plunger 44 and bead chain 62 bias the movement of throttle lever 14 in the direction of arrow B against the movement of diaphragm 42 and the decrease in volumetric capacity of airtight chamber 43.

The mode of operation of the embodiment of the invention as set forth in connection with FIGS. 1–3 will now be described. Rapid depression of the foot actuated throttle pedal moves accelerator rod 15 in the direction of the arrow A. Secondary throttle lever 23 rotating on pivot pin 21 rotates in the direction of the arrow B storing energy in spring 31. The energy is transmitted to adaptor plate 20 causing the plate to pull on chain 62 connected to the dash pot 37. The pressure spring 31 exerts upon adaptor plate 20 is adjusted by placing the one leg of the spring 31 against any one of the different fingers 28. This adjustment compensates for varying resistances in the throttle return spring 16 or in the pneumatic restrictor or dash pot 37.

Normally airtight chamber 43 is held in an expanded position by spring 52. When chain 62 is pulled by adaptor plate 20 in response to pressure exerted by spring 31 diaphragm 42 compresses the air within chamber 43 for resistance to the movement of throttle arms 14 in the direction of arrow B. Adjustable bleed screw 54 provides controlled escape of air in chamber 42 such that the rate of motion of throttle lever 14 can be increased by opening the bleed screw and decreased by closing the bleed screw.

The travel of throttle lever 14 is finally limited by projection 27 which functions as a stop against which adaptor plate 20 rests in a position as determined by the position of the accelerator pedal. Adjustments of spring 31, throttle return spring 16 and bleed screw 54 allow for the comfort of the driver's foot as well as control of throttle action to coincide with the natural ability to the engine to accelerate.

When the driver's foot is removed from the accelerator pedal the combined actions of return spring 16, compression spring 52 and projection 27 serve to return throttle lever 14 and secondary throttle lever 20 in unison to the closed position. Dash pot 37 does not restrict the return of the throttle levers since chain 62 slackens and diaphragm 42 return to its normal position immediately thereafter until the chain is taut again. Quick return of the diaphragm 42 is assured by check valve 53.

Slower opening of the carburetor throttle valve when manifold pressure is high provides for optimal fuel savings but may decrease accelerating capability under high load conditions. In part, this decrease is frustrated by the transmission which manually, when the operator holds the vehicle in lower gears for a longer time, or automatically allows the engine to develop more speed and consequently to develop greater manifold pressure before each gear change. Thus, the system tends to be self-correcting.

However, cancellation of any potential restriction of vehicular acceleration can be provided by conventional overriding devices such as a linkage which causes the chamber 43 of dash pot 37 to vent when the foot pedal is depressed to the limit of its travel or past a preset point.

In an alternate embodiment of the instant invention consideration is given to the fact that the natural rate of acceleration of an engine is a function of the load placed on the vehicle. At the same throttle setting in all cases, a vehicle which is lightly loaded, is accelerating downhill, or has a tailwind, will accelerate to its targeted speed more rapidly than will the same vehicle which is heavily loaded, is accelerating uphill, or has a headwind.

Since the load placed on the vehicle during acceleration is manifested in a decrease in developed manifold vacuum it has been found that it is feasible to utilize the vacuum to vary the rate of compression of the diaphragm and hence the rate of advance of the primary throttle arm in an automatic manner as the demands of the vehicle change with varying driving conditions.

Figure 4:
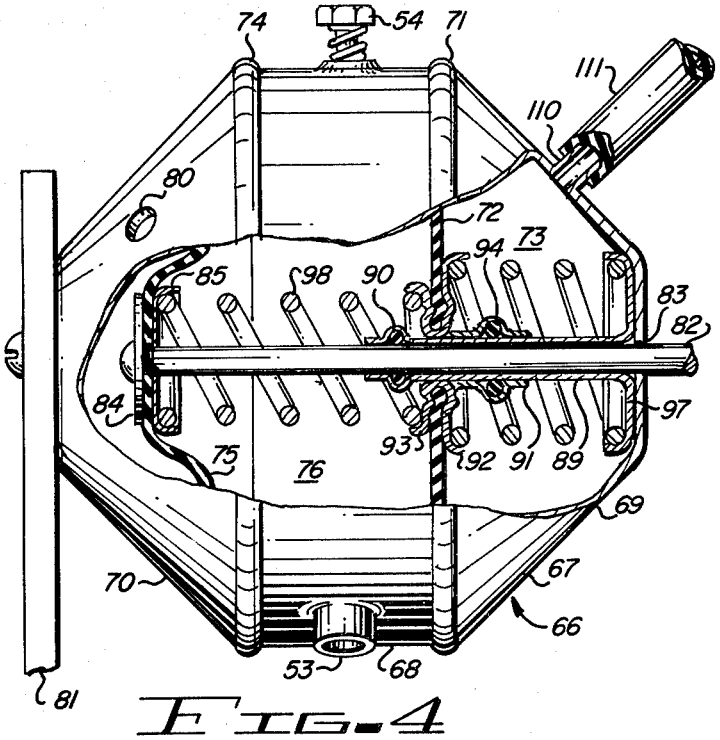
FIG. 4 is an elevational view partly in section of an alternately preferred dashpot for use with the present invention.

One of many possible ways of coupling manifold vacuum with the pneumatic restrictor is shown in FIG. 4. Alternate dash pot generally designated by the reference character 66 has an outer housing 67 formed by center cylindrical section 68 and first and second cup-shaped ends 69 and 70. Constructed similarly to the previously described dash pot 37 first end section 69 is secured to center section 68 by crimped seam 71 which also has the periphery of flexible diaphragm 72 secured therein to form airtight chamber 73. Second end section 70 is affixed to central section 68 at crimped seam 74 which also includes the periphery of diaphragm 75 forming airtight chamber 76 between diaphragms 72 and 75. For purposes of the instant discussion chamber 73 will be referred to as the vacuum chamber while airtight chamber 76 will be referred to as the pressure chamber. The interior of second end section 70 is freely vented to the atmosphere through aperture 80 and dash pot 66 is held by mounting bracket 81.

Plunger 82 extends from the exterior of dash pot 66 through aperture 83 and end section 69 to diaphragm 75 to which the inner end thereof is attacked by washer 84 and cup-shaped member 85. Cup-shaped member 88 abuts the interior wall of first end 69 and has a central tubular hub 89 extending through diaphragm 72 into pressure chamber 76. Plunger 82 is slidable within hub 89 and the integrity of airtight pressure chamber 76 is preserved by O-ring seal 90 carried by hub 89 and sealingly engaged with plunger 82. A second hub 91 is slidably disposed about hub 89 and has integrally formed therewith cup-shaped member 92 which generally corresponds in size to cup-shaped member 88. Another cup-shaped member 93 generally corresponding in size to cup-shaped member 85 is also integrally carried by hub 91 in spaced relationship to cup-shaped member 92 such that diaphragm 72 is sealingly engaged therebetween. O-ring 94 provides an airtight seal between hubs 89 and 91. First compression spring 97 resides between cup-shaped members 88 and 92 and second compression spring 98 is carried between cup-shaped members 85 and 93.

One-way check valve 53 at air bleed screw 54, as hereinbefore described, is carried by center section 68 and operatively associated with pressure chamber 76. Air bleed screw 54 may be provided with an operatively engaged member extending to the dashboard of the vehicle whereby the operator has immediate control over the rate of escape of air from chamber 43. Hose fitting 110 projects from first end section 69 and is open to vacuum chamber 73. Conduit 111 is engaged with hose fitting 110 at one end thereof and to a suitable source of vacuum such as the intake manifold or base of the carburetor at the other end thereof.

In accordance with the instant dash pot 66 spring 97 and diaphragm 72 are stronger in combination than the combination of spring 98 and diaphragm 75. When manifold vacuum is high, i.e., absolute pressure is low, spring 97 is compressed, spring 98 is expanded and the pressure in chamber 76 is larger such that a pull on chain 62 meets with less spring and compression resistance. On the contrary, when manifold vacuum is low, as during protracted accelerations against resistance, chain 62 must compress a stronger contracted spring 98 a smaller volume of air, both of which offer more resistance. A restriction in line 110 serves to restrict the force of vacuum or diaphragm 72 if so required or desired.

Figure 5:
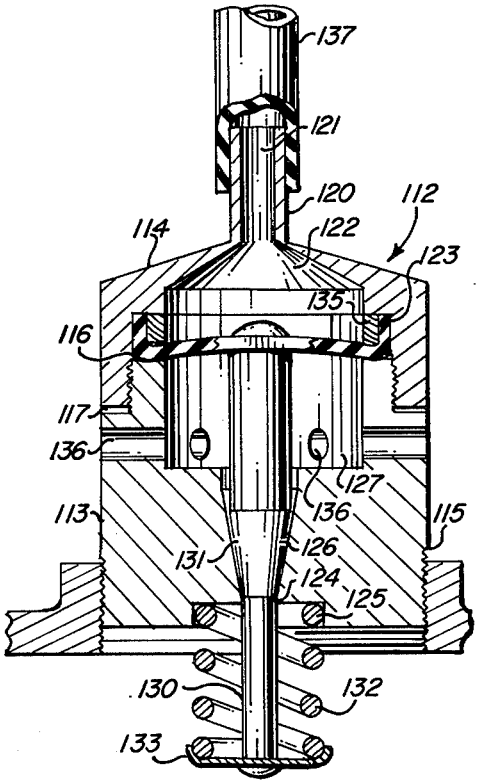
FIG. 5 is a vertical sectional view of an alternate air bleed device which may be incorporated into a dashpot for use with the present invention.

Alternately, manifold vacuum may be coupled with a bleed device generally designated by the reference character 112 in FIG. 5 which would directly replace the previously described bleed screw 54. Bleed device 112 has a housing 113 comprising upper and lower sections 114 and 115 which are threadedly engaged by female screw flight 116 carried by upper section 114 and male screw flight 117 carried by lower section 115.

Hose fitting 120 extends from upper section 114 and has a bore 121 therethrough which communicates with first and second counterbores 122 and 123. Bore 124 extends through lower section 115 and includes recess 125, valve seat 126 and counterbore 127. Stem 130 is slidably disposed in bore 124 and carries valve body 131 which sealing engages with valve seat 126. Compression spring 132 having one end located within recess 125 and bearing against spring retainer 133 normally holds valve seat 126 and valve body 131 in the closed position. Resilient diaphragm 134 centrally secured to the upper end of stem 130 provides a barrier between counterbore 122 and counterbore 127. The periphery of diaphragm 134 is retained in second counterbore 123 by internal snap ring 135. Passages 136 extend through housing 113 and provide for communication between counterbore 127 and the external ambient atmosphere. Conduit 137 provides communication between bore 121 and a suitable source of vacuum such as previously noted.

The operation of bleed devices as generally described in connection with FIG. 5 are known in the art. In response to low pressure at the source thereof a partial vacuum is transmitted through conduit 137 into counterbore 122. Resultantly, diaphragm 134 is drawn upwardly unseating valve body 131 from valve seat 126 allowing the air which is being compressed within the previously described airtight chambers to bleed through the unseated valve into counterbore 127 and into the atmosphere by way of vents 136. A control device such as an orifice, for example, may be interposed in conduit 137 between the bleed device 112 and the source of vacuum to moderate the movement of diaphragm 134.

Figure 6:
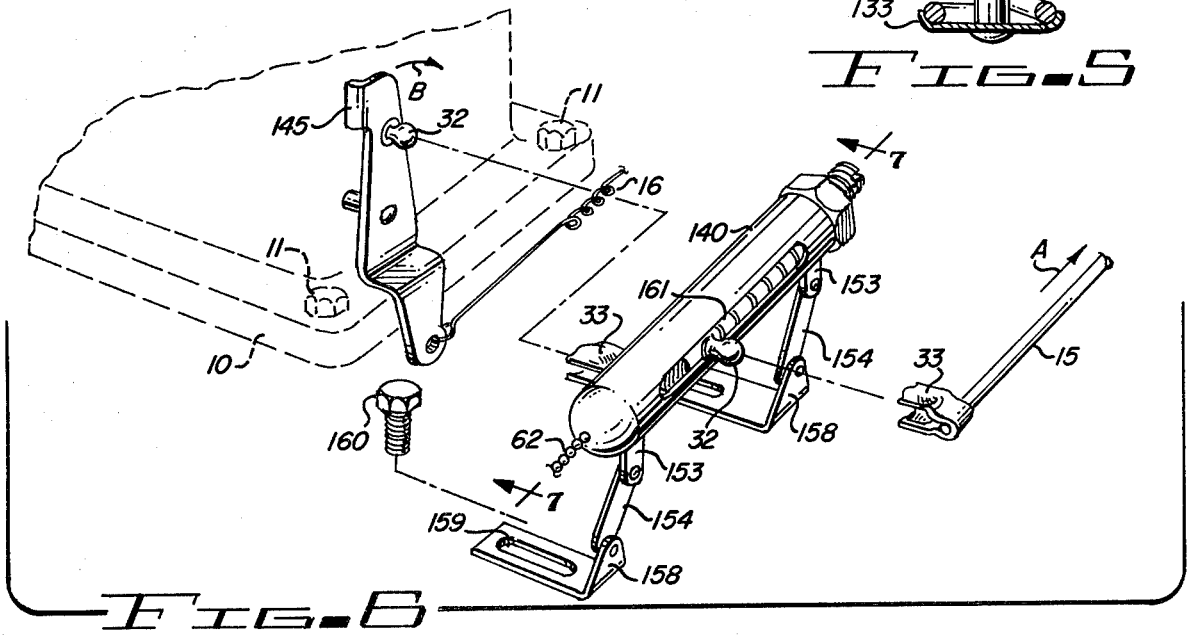
FIG. 6 is an exploded, partial perspective view of an alternate embodiment of the throttle control device of the instant invention.
Figure 7:
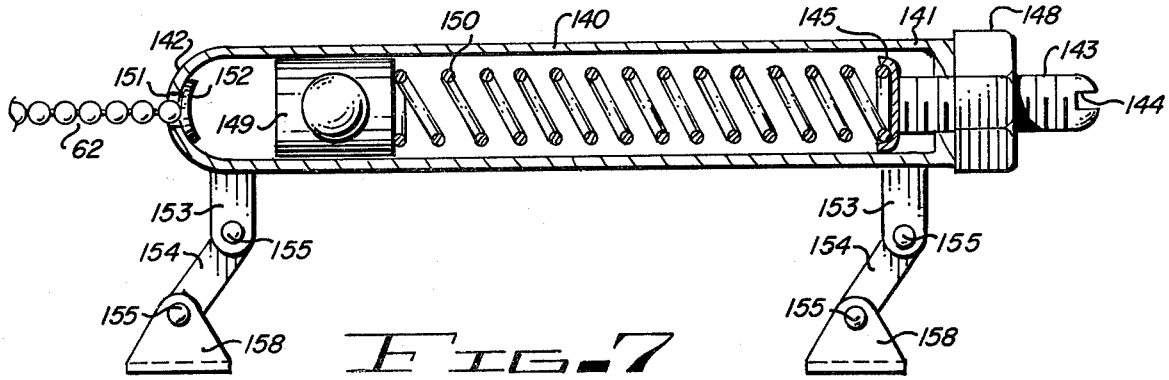
FIG. 7 is a vertical sectional view taken along the line 7—7 of FIG. 6.

Yet another alternate embodiment of a carburetor control device in accordance with the instant invention is illustrated in FIGS. 6 and 7. While the immediate embodiment may be manufactured and sold as an after market accessory the device may be included as standard equipment or option by the original equipment manufacturer. The alternatives are equally applicable to the previously described embodiments. In either case it is understood that the exact details of design configuration are determined by the configuration of the immediate vehicle or the discretion of the designer such engineering considerations in physical shapes still remain within the scope and intent of the instant invention.

Turning now to the embodiment of FIGS. 6 and 7 first provided is an elongate tubular housing 140 having first and second end 141 and 142. Adjusting screw 143 is threadedly engaged with first end 141 and has screwdriver slot 144 and cup-shaped member 145 at respective ends thereof. Lock nut 148 positionally retains adjusting screw 143. Slide member 149 is reciprocally carried within tubular housing 140. Compression spring 150 resides at one end thereof within cup-shaped member 145 and bears against slide member 149 at the other end thereof to normally urge slide member 149 towards second end 142 of tubular housing 140. Bead chain 62 extends through aperture 151 in end 142 and is secured by clip 152. The other end of bead chain 62, not herein specifically illustrated, is operatively connected with a dash pot of the instant invention as hereinbefore described.

A pair of spaced ears 153 depend from tubular housing 140. An arm 154 is pivotally connected to either ear 153 by pins 155. Preferably pins 155 are rivets upset on either end thereof to maintain the two elements as an assembly and being pivotal in either or both members. Similarly, mounting tabs 158 are pivotally connected by additional pins 155 to arms 154. Mounting tabs 158 include apertures 159 which receive bolts 164 convenient mounting adjacent carburetor 10.

As previously described herein in accordance with conventional practice the throttle lever includes an attachment member which movably receives a mating attachment member carried by the throttle linkage. For purposes of illustration in the immediate embodiment ball connector 32 projects from throttle lever 14 and pivotally receives ball socket clip 33 carried by throttle rod 15. An elongate slot 161 extends longitudinally along the side of tubular housing 161. A corresponding ball attachment 32 is carried by slide member 149 extends through slot 161 and receives ball socket clip 33 carried by accelerator rod 15. A second ball socket clip 33 is secured to tubular housing 140 and engages ball connector 32 carried by lever arm 14.

The operation of the embodiment of the instant invention described in connection with FIGS. 6 and 7 are analogous to the immediately described embodiments. Briefly, movement of accelerator rod 15 in the direction of arrow A pulls slide member 149 towards first end 141 of tubular housing 140 compressing spring 150. The energy thus stored in spring 150 urges tubular housing 140 in the direction of arrow A. The tension on spring 150 is, of course, variable by adjusting screw 143. The movement of tubular housing 140 in the direction of arrow A which would result in movement of throttle lever 14 in the direction of arrow B is resisted by the dashpot.

FIGS. 8 through 12 illustrate still another embodiment of the present invention which is generally designated by the numeral 160. In accordance with this embodiment of the invention, the pneumatic restrictor or dashpot, designated by the numeral 37 in FIG. 1, and return spring 60 have been combined into a single bellows unit 162. The bellows unit 162 is operatively connected to the throttle lever to oppose the opening of the throttle. Throttle lever 164 and adapter plate 166 are secured together in unitary fashion by rivets or bolts 168 and 170. As has been described with reference to previous figures, throttle plate or lever 164 is secured to a shaft which carries the throttle valves to regulate the opening in the throttle bore.

Linkage member 176 has an eye or hook 178 secured about bolt 170. The opposite end of linkage member 176 is secured to bellows 162 at bracket 180. Projections 184 and 186 provided at opposite sides of the adapter plate and serve as limit stops for movement of the secondary throttle plate 190 and the throttle level 164 as will be explained.

The secondary throttle plate 190 is pivotal on axle rod 192. Rod 192 extends through bore 194 in adapter plate 166 and is secured in position at the head of the axial rod. The rod 192 projects through bore 198 in secondary throttle plate 190. Coil spring 200 has opposite end projections 204 and 206 which respectively engage holes 208 and 210 in the adapter plate and secondary throttle plate. A snap ring or retainer clip 212 engages a groove 214 adjacent the outer end of shaft 192 to secure the adapter plate in position on the shaft. A ball arm 215 is attached to the secondary throttle plate at bore 216. The ball socket is held in place by a nut 218. The ball arm is connected to a rod which is a conventional part of the accelerator linkage and is responsive to movement of the throttle or accelerator pedal located in the vehicle operator compartment.

As has been mentioned above, movement of the throttle plate or lever 164 is opposed by bellows 162. Bellows 162 is best illustrated in FIGS. 9 through 12. Bellows 162 has a cylindrical expansible body 220 which is shown in a compressed position in FIG. 9 and in an expanded position in FIG. 10. A coil spring 225 is positioned within the bellow chambers 226 defined by the expandable housing 220 and opposite end plates 222 and 250. End plate 222 has a circumferential groove 226 which engages internal peripheral projection 224 at one end of bellows housing 220. End plate 222 has axial bore 228 communicating with passages 230 and 232. A check valve, as for example, a ball check or poppet valve 234 positioned in passageway 230 so that during contraction of bellows chamber 226, air is discharged from the chamber across valve 230. An adjustable bleed screw 238 of conventional slotted head design is in threaded engagement in passageway 232. Bleed screw 238 provides for control entry of air into chamber 226 during expansion of the bellows 162.

The opposite end of bellows 162 is closed by end plate 250. End plate 250 has a circumferential groove 252 which engages peripheral projection 254 on the interior of the bellows. Bracket 180 projects from the exterior side of end plates 250 and is secured to linkage number 176. Clamps 251 also assist in securing the end plates 222 and 250 to the bellows housing.

The mode of operation of this embodiment of the present invention will now be described. Depression of the foot actuated throttle pedal moves accelerator rod in a direction causing secondary throttle plate 190 to rotate in a clockwise direction as viewed in FIG. 8. Secondary throttle plate 190 will rotate until the edge of the plate engages limit stop 186 on adapter plate 166. Rotation of secondary throttle plate 190 will store energy in spring 204 and transmit this energy to adapter plate 166. The energy transmitted to the spring will tend to impart rotation to the unitary assembly of throttle lever plate 164 and adapter plate 166 in a clockwise direction as shown in FIG. 8. The rotation of the throttle plate will open the throttle bore. Rotation for movement of throttle plate 164 is opposed by bellows 162. In the normal position, bellows 162 is compressed in the position shown as FIG. 9. The coil or compression spring 225 is also in a relaxed position as shown in FIG. 9.

When a force is exerted on linkage 176 through bolt 170 in response to pressure exerted by spring 202, the bellows expands, air being admitted across bleed valve 238. The travel of throttle lever 164 is limited by projection 184 which functions as a stop when the adapter plate engages the secondary throttle plate.

When the drivers foot is removed from the accelerator pedal, the combined effects of compression spring 225 and main spring 204 serve to return the throttle lever 164 and the adapter plate 216 as a unit to the closed position. Quick return is not impeded as air is permitted to escape from bellows chamber 226 across check valve 234.

Adjustment of bleed screw 238 and of the spring rate of main spring 204 and spring 225 allow for adjustment in accordance with driver's preference and with the operating characteristics of the engine. Generally these springs and the adjustment of the bleed screw will be selected in accordance with the characteristics of the engine.

A throttle control device constructed in accordance with the teachings of the present invention has been tested. The test results, which are indicative of the performance of the various embodiments thereof is set forth below.

A Ford Motor Company automobile manufactured in 1968 and equipped with a 390 cubic inch V-8 engine, a two barrel carburetor and an automatic transmission was fitted with the instant device, burettes to feed gasoline to the carburetor and a three-way valve in the fuel line to allow switching to the vehicular fuel tank when measurements of fuel consumption were not in progress. The vehicle otherwise was unchanged from factory design. The tests were conducted on a Clayton model 200S dynamometer with a fixed load such that the engine would develop 28.0 horsepower at 50 miles per hour.

The results of the foregoing experimentation are set forth in the following table taken from dynamometer testing data which simulates actual road conditions.

EFFECTS OF PNEUMATIC RESTRICTION ON ACCELERATION RATES AND FUEL CONSUMPTION

| Run No. | Device Operating | % of Full Throttle | Time to 60 mph, sec. | Fuel Consumed cc. |
|---|---|---|---|---|
| 1 | No | 100 | 10.1 | 175 |
| 2 | No | 90 | 10.1 | 155 |
| 3 | No | 80 | 10.1 | 135 |
| 4 | No | 70 | 10.9 | 115 |
| 5 | No | 60 | 12.0 | 100 |
| 6 | No | 50 | 13.7 | 90 |
| 7 | Yes | 100 | 10.1 | 115 |
| 8 | Yes | 90 | 10.1 | 115 |
| 9 | Yes | 80 | 10.2 | 115 |
| 10 | Yes | 70 | 11.0 | 105 |
| 11 | Yes | 60 | 12.1 | 95 |
| 12 | Yes | 50 | 13.8 | 85 |

Without changing the dynamometer loading the testing commenced by accelerating the automobile through the gears from 0 to 60 miles per hour at full throttle while measuring the time required and the fuel consumed by volume (Run No. 1). In the same manner accelerations were made at 90, 80, 70, 60 and 50 percent, respectively, of full throttle as gauged by a clamp on the throttle cable at 5 equidistant positions. The 50% figure was obtained by securing the clamp at the midpoint between fully open and fully closed throttle. These results are reported as Runs 2–6.

Subsequently, a device of the instant invention, as set forth in FIGS. 1–3, was attached and the tests were repeated. The subsequent tests are set forth as Runs 7–12. The bleed screw was adjusted until the rate of acceleration at full throttle with the device attached corresponded to the rate of full throttle acceleration without the device.

Several phenomena were gleaned from the tests. Firstly, accelerations at more than approximately 80% of full throttle without the device of the instant invention consumed more fuel but did not result in faster accelerations. Secondly, with the device adjusted for no dimunition of the acceleration rate, fuel savings reached a maximum of 66% at full throttle and decreased relative to fixed throttle accelerations without the device as the rate of acceleration decreases. Below 50% of full throttle acceleration to 60 miles per hour is impractically slow but measurable fuel savings will be realized. Most of the fuel saving at the lower accelerations occurs during the first few seconds of acceleration in each gear range when manifold vacuum is lowest. Therefore, a greater percentile of savings is realized at slower accelerations to lower target speeds such as 30 miles per hour.

By adjusting the bleed screw towards the closed position the maximum accelerating capability of the vehicle can be decreased gradually with concomitant increases in fuel savings. Thus, the vehicle operator who is satisfied with less performance from his vehicle can obtain greater fuel savings than those tubulated in the table.

Various changes and modifications to the devices herein chosen for purposes of illustration will readily occur to those skilled in the art. It is obvious, for example, that since the pneumatic restrictor or dash pot and the return spring are operating in parallel with the carburetor throttle lever a suitable pneumatic restrictor can be placed in the position and function of the return spring provided that the spring tension is adjusted to effect return of the carburetor throttle lever when the actuating force is removed from the foot pedal.

Similarly, the essential elements of this invention can be built into or on the reverse side of the carburetor from that illustrated in the drawings. For example, the linkage is connected to the carburetor throttle lever as hereinbefore described while the dash pot is mounted on the opposite side of the carburetor and controls the throttle valve by means of an arm extending from the throttle shaft and a collapsible link such as the bead chain. Further, it is apparent that the device of the instant invention can be interposed into the throttle linkage intermediate the carburetor and foot throttle as, for example, by mounting to the conventional fire wall.

The specific embodiments of the instant invention previously illustrated and described herein were selected on the basis of familiarity, availability, ease of manufacture by known methods and other considerations. However, it is understood that the invention is not limited to the specific physical configurations thereof but that modifications may be made in the scope of the invention and such variations are covered by the spirit and scope of the appended claims.

Having fully described and disclosed the present invention and the preferred embodiments thereof in such clear and concise terms as to enable those skilled in the art to understand and practice the same, the invention claimed is:

1. In a carburetor for controlling the air/fuel mixture available to an internal combustion engine, which carburetor includes,
   - a throttle body,
   - a throttle valve carried by said throttle body,
   - a throttle lever for controlling the movement of said throttle valve between a closed position and an open position,
   - a linkage for operatively moving said throttle lever, and
   - biasing means normally urging said throttle to the closed position, an improved device for modulating the rate of opening of said throttle valve during opening movements of said linkage and for dampening rapid or erratic opening movements of said linkage, said improved device comprising:

(a) a resiliently deformable member for receiving and storing energy in response to opening movement of said linkage and for transmitting said energy to said throttle lever for opening said throttle valve;

(b) pneumatic restrictor means opposing the movement of said throttle lever and regulating the speed at which said throttle valve opens, said restrictor including:

(i) a hollow housing;

(ii) a flexible diaphragm hermetically sealed to said housing to form an airtight chamber therein, said diaphragm being movable in a first direction to increase the volumetric capacity of said chamber and movable in a second direction to decrease the volumetric capacity of said chamber;

(iii) biasing means normally urging said diaphragm in said first direction;

(iv) one-way check valve means for the introduction of ambient air into said chamber as said diaphragm moves in said first direction; and (v) air bleed means for controlling the rate of discharge of air from said chamber as said diaphragm moves in said second direction.

(c) coupling means extending between said flexible diaphragm and said throttle lever, said coupling means operatively interconnecting said flexible diaphragm and said throttle lever when said throttle lever is moved toward an open position, to oppose and modulate the opening of said throttle, said coupling means disconnecting said flexible diaphragm and said lever when said throttle means is moved toward a closed position whereby said throttle lever is free to move to said closed position independent of said pneumatic restrictor.

2. The carburetor modulating device of claim 1 wherein said air bleed means is responsive to a source of engine vacuum, whereby the rate of discharge of air from said chamber increases in proportion to increase in vacuum.

* * * * *